United States Patent [19]

Ibarra

[11] Patent Number: 4,744,283

[45] Date of Patent: May 17, 1988

[54] MORTAR

[75] Inventor: Iñigo A. Ibarra, Vizcaya, Spain

[73] Assignee: Esperanza y Cia, S.A., Spain

[21] Appl. No.: 849,817

[22] Filed: Apr. 9, 1986

[30] Foreign Application Priority Data

Mar. 17, 1986 [ES] Spain ..... 292983
Mar. 17, 1986 [ES] Spain ..... 292986

[51] Int. Cl.[4] ..... F41F 13/04

[52] U.S. Cl. ..... 89/27.12; 89/37.05; 89/26

[58] Field of Search ..... 89/37.05, 40.02, 1.35, 89/27.11, 27.12, 26, 27.14, 27.13

[56] References Cited

U.S. PATENT DOCUMENTS

| | | | |
|---|---|---|---|
| 417,693 | 12/1889 | Wiegand | 89/27.11 |
| 2,477,253 | 7/1949 | Jasse | 89/27.11 |
| 3,074,322 | 1/1963 | Jasse | 89/27.11 |
| 4,222,306 | 9/1980 | Maury | 89/1.41 |

FOREIGN PATENT DOCUMENTS

| | | | |
|---|---|---|---|
| 1571434 | 6/1969 | France | 89/27.11 |
| 16079 | of 1908 | United Kingdom | 89/27.11 |
| 2000851 | 1/1979 | United Kingdom | 89/27.11 |

*Primary Examiner*—Stephen C. Bentley
*Assistant Examiner*—Stephen M. Johnson
*Attorney, Agent, or Firm*—Lucas & Just

[57] ABSTRACT

The improved mortar has a sealing means that provides a double seal to the firing pin so that hot ignition gases from the mortar tube are prevented from damaging the firing mechanism. The improved mortar also has an improved base plate, the improvement in the base plate being an even number of radial ridges that extend radially from the base plate and are arranged in equal angles at the center. Every other radial ridge is forked and the branches of the forked radial ridges are parallel to the adjacent non-forked radial ridges.

8 Claims, 3 Drawing Sheets

MORTAR

Known mortars have been shown to possess, among others, the following disadvantages:

(a) The base plates sink and become driven into the ground to such an extent that it is very awkward to pull them out when it is wished to remove the mortar elsewhere;

(b) The firing mechanism parts are quickly damaged due to the effect of the ignition gases;

(c) The safety mechanisms are exceedingly complex;

(d) The percussion mechanisms are exceedingly complex.

These and other drawbacks have been overcome by the purpose of this invention as is explained hereunder.

Figure 6:
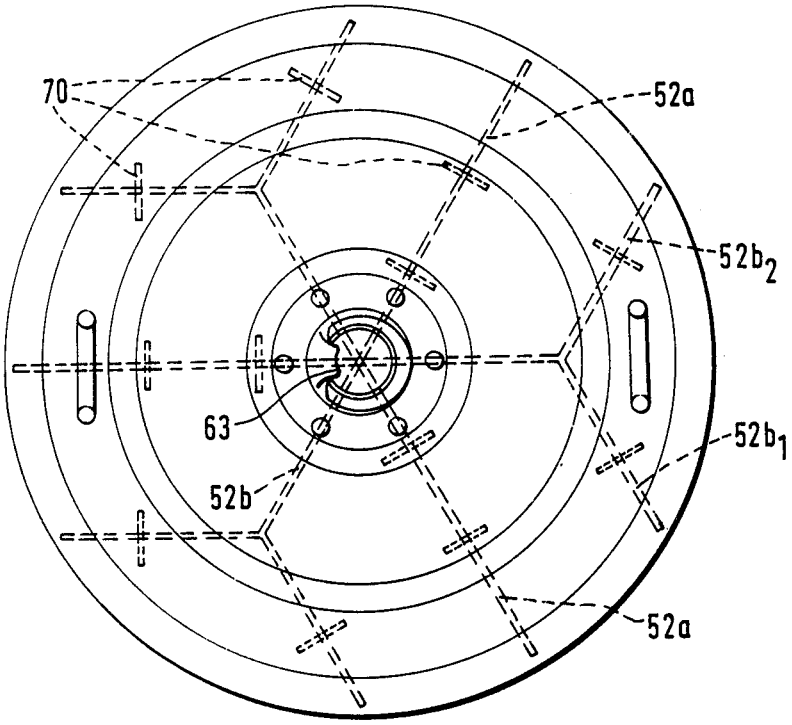
FIG. 6 is a top plan view of the improved base plate for mortars which corresponds to the preceding figure.

In this FIG. 6, dotted lines are included to illustrate the particular shape of the various ridges (52).

The improved base-plate for mortars as covered by this invention is made up from a body (51) or platform as such, which possesses:

an upper face (61) shaped approximately in the form of a spherical cap within which are housed the means for locking the mortar as described hereunder;

a number of ridges (52) on its lower face which rest upon the firing position and steady the assembly.

Ridges (52) are of varying height (see FIG. 5) and offer essentially "Vee" shaped sections with arms asymmetrical both in height as well eventually as slope. They are arranged in an even number in radial formation (See FIG. 6).

There are, in this arrangement, ridges of two kinds:

simple radial ridges (52*a*);

forked radial ridges (52*b*).

Figure 5:
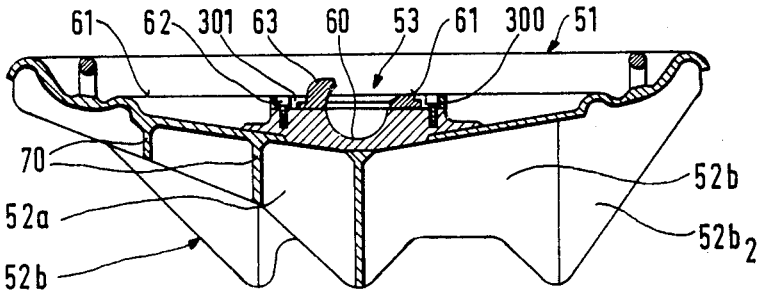
FIG. 5 is an elevational cross section view of the improved base plate for mortars in accordance with the invention. In this figure, the particular shape may be seen both of the ridges (2) as of the means for locking (3).

The radial ridges (52*b*) are forked beyond their central area into two branches (52*b*$_1$), (52*b*$_2$), and said branches (52*b*$_1$), (52*b*$_2$) are in a parallel position to their respective adjacent non-forked ridges (52*a*) (See FIGS. 5 and 6).

Ridges (52*a*), (52*b*) are completed subsidiarily by a number of small reinforcement ridges (70) arranged at various locations and at right angles thereto.

The means for locking the mortar are, for the sake of this practical construction, as follows:

a support (61) fitted onto the body (51) by means, for example, of a welded attachment;

a ring (300) attached to the support (61) by means of screws (62) and where, between said ring (300) and said support (61), there is defined a hollow (301) into which is embedded the claw (63) which can slide rotatingly therein;

the support (61) possesses a spherical shaped concave hollow (60) into which the mortar locking ball (6) is inserted.

The securing lug (33) holds the ball (6) except in a hollow (7) provided for the purpose in said locking ball (6) for the removal thereof.

The thickness of the barrel (1) wall is greater up to a height which is similar to the height that exists between the base and the forcing bands on the longest projectile of those used in the barrel bore in question, than the remainder of the barrel in order to provide strengthening at the areas which are required to withstand the greatest pressure when firing takes place.

Barrel (1) is provided with a screwed thread (3) by which it is joined to the cover (2).

Barrel (1) is also provided with a stop (4) upon which cover (2) abuts.

Positioning of the barrel (1) with respect to the cover (2) is maintained by means of locking pins (5).

Cover (2) possesses a ball (6) for positioning same in the relevant base (not shown) where there is a hollow (7) to facilitate its removal from the appropiate gulley for its base.

Cover (2) is provided with a hole (8) in which a sheath (9) is able to slide, where part of the outside surface of said sheath (9) is in the form of a toothed rack (10).

Inside the sheath (9), there is an activating spring (11) into which is inserted the stem (12) of a hammer (13) which slides within sheath (9).

Said sheath (9) possesses a pin (14) which slides inside a hole (15) pierced in the hammer (13).

The mortar firing assembly is comprised of a firing piece (16) upon whose head there is the firing pin (17) whose point (18) is round and tapered, and a base (19) which is shaped as a truncated cone. Firing piece (16) possesses moreover a cylindrical central body (20) which joins the head to a rear body (21), the diameter of which is greater than that of said central body (20).

The rear body (21) terminates in a domed or spherical surface upon which hammer (13) will strike.

There is also provided a case (22) for the firing pin (17), with a hole through which protrudes the point (18) of said pin (17), and a seat in the form of a truncated cone (23) for firing pin (17). This case (22) possesses a screwed thread (24) for attachment thereof into a hole in cover (2).

Said case (22) is provided also with a securing flange (25).

A sealing sleeve (26) is arranged inside case (22) with a seat in the form of a truncated cone (27) for the base (19) of the firing pin (17) head, and inside said sleeve (26), the end of sheath (9) is capable of sliding.

To achieve improved tightness of the assembly, pressure rings (28) are included between the joints of the various parts, such as between the flange (25) and the cover (2), and the bottom of case (22) and the cover (2).

Hollows (29) are moreover provided inside the case (22) for the purpose of facilitating the ejection of gases and waste matter.

At the area upon the sheath (9) which is adjacent to the central body (20) of the firing pin (17), there is a stub (30) whose purpose is to draw the firing pin (17) back to its idle position.

In engagement with toothed rack (10) there is provided pinion (31) coupled to a shaft (32) which is rotatingly operated by an outside firing handle.

A thrust point (33) is arranged in assembly with said pinion (31) and undergoes the same motion as it does.

From outside of cover (2), the operator can operate a plug (34) upon which there is pressing a spring (35) which acts upon a stepped claw (36).

Also provided is an externally operated handwheel (37) to which is attached an internal sleeve (38) possessing a threaded inside hole into which is screwed a bevel headed (40) wedge (39).

Also attached to handwheel (37) is an external positioning sleeve (41).

Wedge (39) possesses a key (42) which is capable of sliding inside keyway (43) on cover (2).

Sheath (9) is provided with a first window (44) and a second window (45) into which the bevelled head (40) of wedge (39) is capable of being inserted. Of course, instead of windows, these features may be simple slots or the like.

The assembly is handled by its handles (46).

Figure 1:
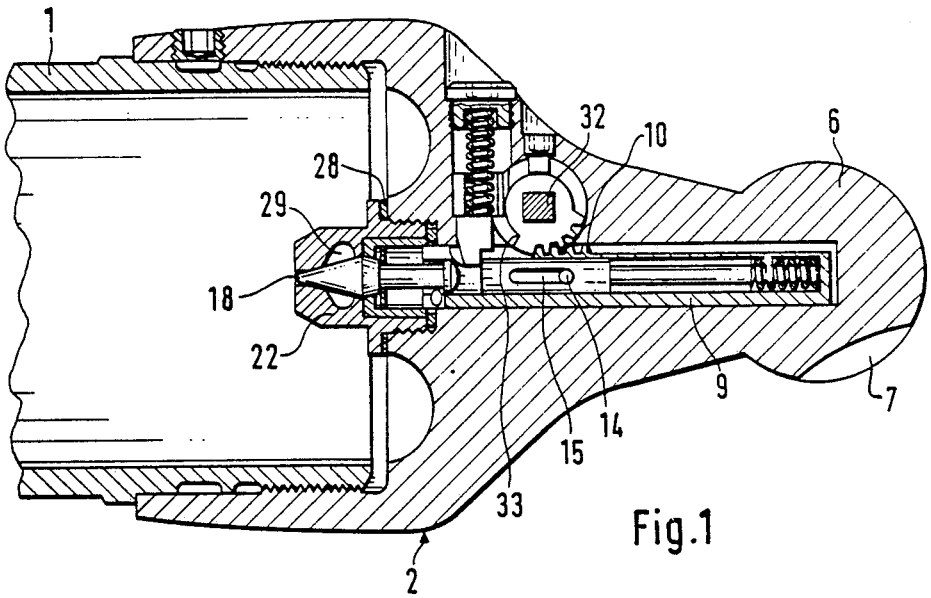
FIG. 1 is a cross section view with the assembly of the mechanisms at rest.
Figure 2:
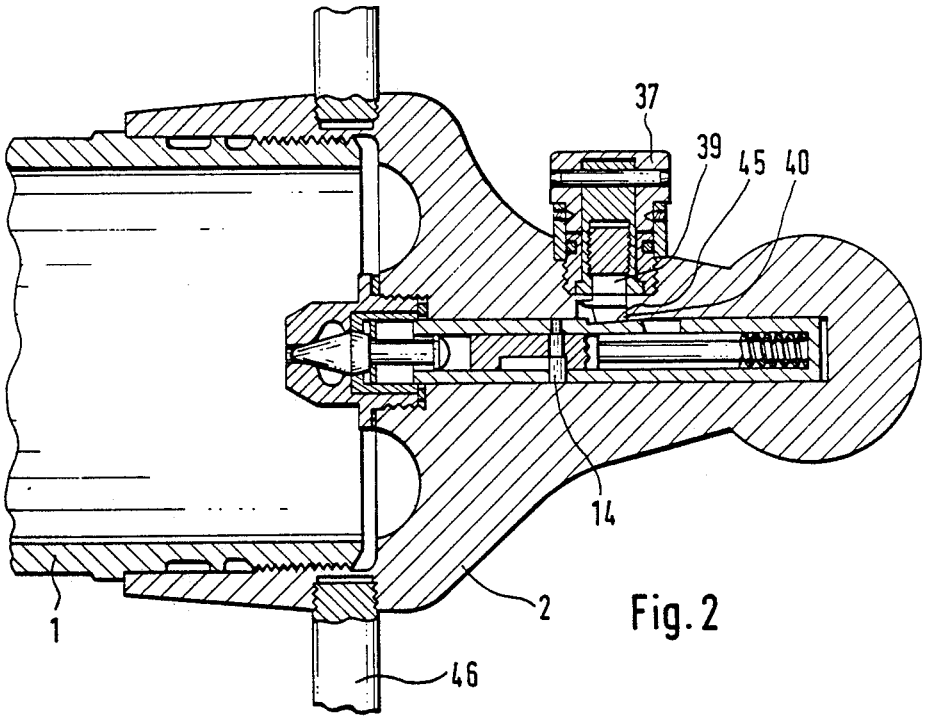
FIG. 2 is a cross section view of the assembly in the safety position.

The mode of operation is as now described:

Starting from the safety position (FIG. 2) in which the bevelled head (40) is inserted in the second window (45) which acts as a safety window because so long as this position is maintained, all movements of the mortar inside mechanisms are prevented, if handwheel (37) is operated, wedge (39) is raised and sheath (9) is freed when the bevelled head (40) emerges from the second window (45) and thus comes into the position as illustrated in FIG. 1.

Hammer (13), which abuts against the last step on the claw (36), is under the action of spring (11).

Figure 4:
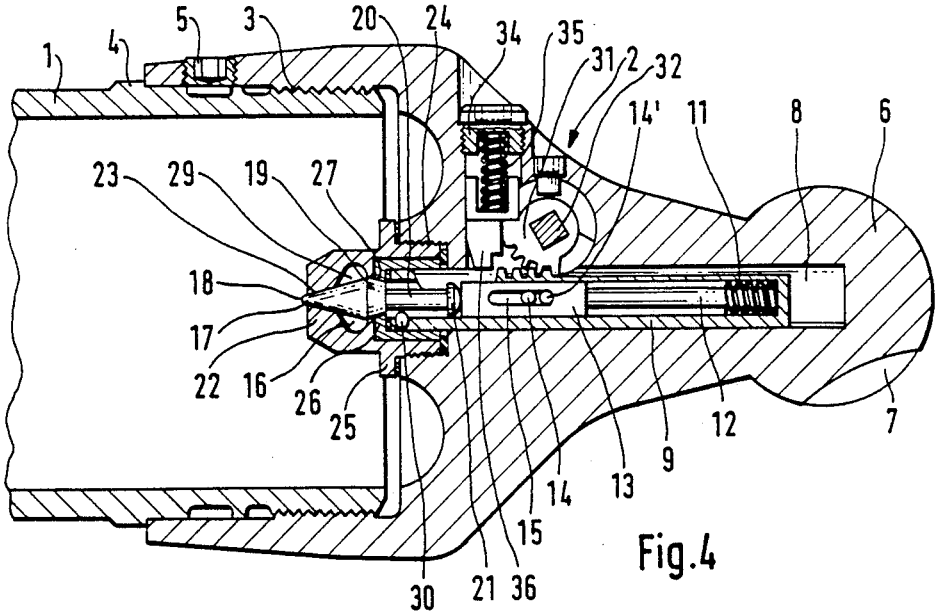
FIG. 4 is a cross section view of the assembly in the normal firing position.

When the handle (not shown) is operated, spindle (32) is made to rotate, and this in turn revolves pinion (31) which being in engagement with toothed rack (10), shifts it together with pin (14) so as in this way to compress spring (11) even further until when, by continuing the rotation, a thrust point (33) engages with a step on the claw (36) and causes it to travel against the force exerted by the spring (35), whereupon the position is that illustrated in FIG. 4, where hammer (13) has become released from claw (36) and under the action of spring (11), it strikes the head (21) of the firer (16) whose point (18) protrudes from the hole in case (22) so as to hit the cap of the cartridge in the relevant shell.

The dual truncated cone shaped seat for the needle (17) in the case (22) and in the base (19) of the sheath (26) provides absolute tightness which prevents as far as possible the firing organs from being exposed to the high temperatures from the gases produced upon firing.

When it is wished to return to the idle position, but without the safety catch being applied, the handle is moved back to its original position, and with it travel the pinion (31), the toothed rack (10), the point (33), the claw (36), while the pin (14) shifts the hammer (13) and the stub (30) shifts the head (21) of the firer, whereupon everything is again as illustrated in FIG. 1.

Figure 3:
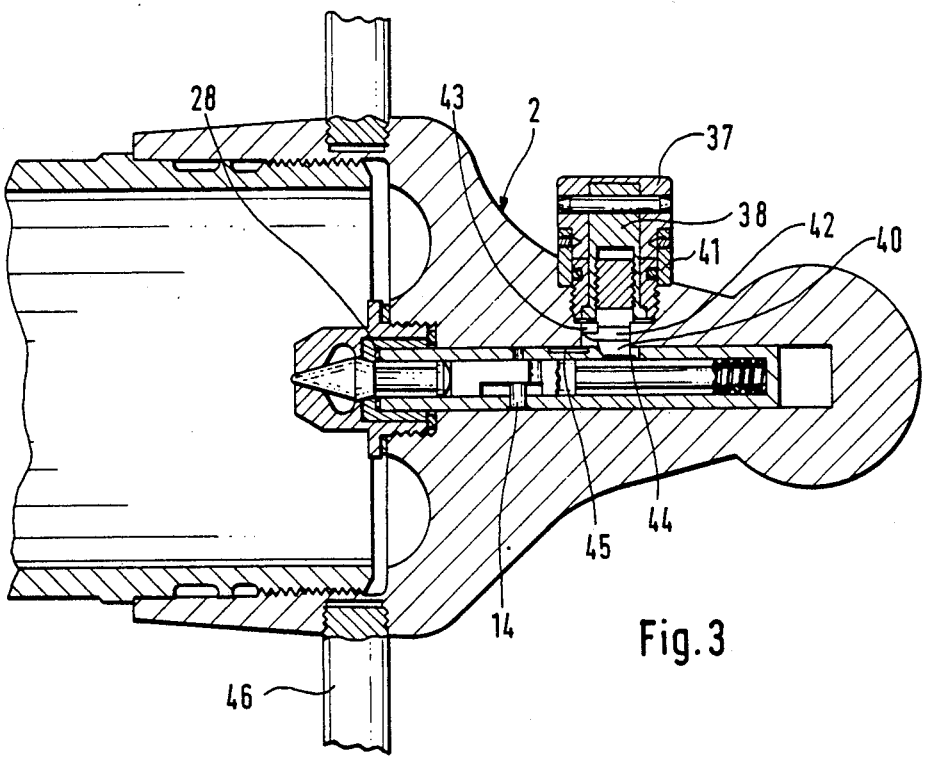
FIG. 3 is a cross section view of the assembly in the automatic percussion position.

If it is desired to achieve the automatic firing position (FIG. 3) then, starting from the firing position as illustrated in FIG. 4 and with the handle being kept in the firing position, the handwheel (37) is operated in order to make the bevelled head (40) of the wedge (39) become inserted inside the first window (44) on the sheath (9) so that this latter is held immobile with hammer (13) positioning the firer (16), the pin (17) of which protrudes with its point (18) through the hole in case (22) wherewith it is in permanent readiness to fire.

The mere dropping of the shell into the slide of the barrel (1) will cause it to fire.

For the removal of pin (14), there is provided on the sheath and facing same, a hole (14').

I claim:

1. An improved mortar having a barrel and a cover, said cover having one end that attaches to said barrel and another end that attaches to a base plate, said cover having a blind hole therein coaxial with said barrel, said blind hole having an open end at said one end of said case, said mortar comprising:

(a) a hollow sheath slidably positioned in said blind hole, said hollow sheath movable between a rest position and a firing position, said hollow sheath having an outer surface and an inner surface, said outer surface having a toothed rack mounted thereon, said inner surface having a pin mounted therein;

(b) a spring mounted in said hollow sheath towards said other end of said blind hole;

(c) a hammer slidably positioned in said hollow sheath, said hammer operated on by said spring, said hammer having a groove therein, said pin of said hollow sheath positioned in said groove of said hammer;

(d) a first means for holding said hammer in a cocked position when said hollow sheath is in said rest position, said first means mounted in said cover;

(e) a drive pinion mounted in said cover, said pinion meshing with said toothed rack thereby effecting movement of said hollow sheath between said rest position and said firing position;

(f) a second means attached to said pinion to release said first means when said hollow sheath moves from said rest position to said firing position;

(g) a case attached to said cover and closing said open end of said blind hole, said case having a through hole, said through hole being coaxial with said barrel, said hole having a first truncated cone seating section;

(h) a sleeve housed inside said case, said sleeve having a second truncated cone seating section; and (i) a firing pin member having a firing pin head, a central body and a rear body, said firing pin head having a tapered, rounded head and a truncated cone base, said firing pin member positioned in said through hole and in said sleeve, said firing pin member movable with said hollow sheath between said rest position and said firing position such that a first seal forms between said tapered, rounded head of said firing pin head and said first truncated cone seating section, and a second seal forms between said truncated cone base of said firing pin head and said second truncated cone seating section, said first seal and second seal being formed when said firing pin member is in said rest position and in said firing position.

2. The improved mortar of claim 1 wherein said tapered, rounded head of said firing pin head has an upper section and a lower section and said case has an internal hollow positioned therein such that said first truncated cone seating section forms said first seal with said upper section of said tapered, rounded head of said firing pin head and said internal hollow is positioned about said lower section of said tapered, rounded head of said firing pin head.

3. The improved mortar of claim 1 wherein said case has a flange which abuts said cover and a base which screws into said blind hole and said mortar further comprising pressure rings between said flange and said cover and between said base and said blind hole.

4. The improved mortar of claim 1 wherein said hollow sheath has a stub mounted on said inner surface for interacting with said central body of said firing pin member.

5. The improved mortar of claim 1 wherein the first means comprises movable stepped claw acted on by an internal spring.

6. The improved mortar of claim 1 further comprising a hand wheel mechanism mounted on said cover to lock said hollow sheath in said rest position or said firing position.

7. The improved mortar of claim 1 wherein said sheath has a hole therein to facilitate disassembly.

8. The improved mortar of claim 6 wherein said hollow sheath has a first window and a second window and said hand wheel mechanism has a bevel headed wedge, said bevel headed wedge acting with said first and second window to affect locking of said hollow sheath in said firing and rest positions.

* * * * *